US009708890B2

(12) United States Patent
Skjeie

(10) Patent No.: US 9,708,890 B2
(45) Date of Patent: Jul. 18, 2017

(54) BLOWOUT PREVENTER CLEANING TOOL

(71) Applicant: ARCHER OILTOOLS AS, Stavanger (NO)

(72) Inventor: Trond Skjeie, Hundvåg (NO)

(73) Assignee: ARCHER OILTOOLS AS, Stavanger (NO)

( * ) Notice: Subject to any disclaimer, the term of this patent is extended or adjusted under 35 U.S.C. 154(b) by 0 days.

(21) Appl. No.: 14/771,742

(22) PCT Filed: Mar. 1, 2013

(86) PCT No.: PCT/NO2013/050043
§ 371 (c)(1),
(2) Date: Aug. 31, 2015

(87) PCT Pub. No.: WO2014/133393
PCT Pub. Date: Sep. 4, 2014

(65) Prior Publication Data
US 2016/0017692 A1 Jan. 21, 2016

(51) Int. Cl.
*B08B 9/04* (2006.01)
*E21B 37/02* (2006.01)
(Continued)

(52) U.S. Cl.
CPC ..... *E21B 37/02* (2013.01); *B08B 9/0436* (2013.01); *B08B 9/053* (2013.01); *E21B 23/04* (2013.01); *E21B 33/06* (2013.01); *E21B 34/14* (2013.01)

(58) Field of Classification Search
CPC ..... E21B 37/02; E21B 23/04; E21B 33/06; E21B 34/14; B08B 9/0436
(Continued)

(56) References Cited

U.S. PATENT DOCUMENTS

2007/0029889 A1* 2/2007 Dunn ..... H02K 21/24 310/156.43
2007/0261855 A1* 11/2007 Brunet ..... E21B 37/02 166/312

FOREIGN PATENT DOCUMENTS

EP 0 654 581 A2 5/1995
GB 2 323 871 A 10/1998
(Continued)

*Primary Examiner* — Duy Deo
*Assistant Examiner* — Maki Angadi
(74) *Attorney, Agent, or Firm* — Birch, Stewart, Kolasch & Birch, LLP

(57) ABSTRACT

A BOP cleaning tool includes a first pipe section with a through central channel and radial channels to external fins, with nozzles for flushing fluid from the central channel out into a BOP bore for washing cavities in the BOP bore, the central channel provided with a flow control sleeve provided with holes, the flow control sleeve displaceable from a radially closed initial first closed position to a second position with the holes aligned with the inner radial channels for starting flushing through the nozzles, and further displaceable to a radially closed third position with the holes out of alignment with the inner radial channels for halting the flushing through the nozzles. The flow control sleeve is displaceable from the first, initial position by a first dart dropped into the first pipe section and stopping in a first seat in the flow control sleeve below the holes, thereby closing the central channel, building pressure in the central channel, displacing the flow control sleeve to the second position and redirecting pipe flow to the nozzles. Flow control sleeve is displaceable from the second position to the third, closed position by a second dart dropped into the first pipe section and stopping at the first dart, the second dart blocking the holes thereby building pressure in the first pipe section, further displacing the flow control sleeve to the third posi-
(Continued)

tion triggering a release mechanism for the first seat to release the first dart and the second dart.

5 Claims, 8 Drawing Sheets

(51) Int. Cl.

| | |
|---|---|
| ***E21B 23/04*** | (2006.01) |
| ***E21B 34/14*** | (2006.01) |
| ***B08B 9/043*** | (2006.01) |
| ***B08B 9/053*** | (2006.01) |
| ***E21B 33/06*** | (2006.01) |

(58) Field of Classification Search
USPC ..... 134/8, 22.1, 23, 22.11, 32; 166/312, 173
See application file for complete search history.

(56) References Cited

FOREIGN PATENT DOCUMENTS

| | | | | |
|---|---|---|---|---|
| WO | WO 99/14461 | A2 | | 3/1999 |
| WO | WO-03087526 | | * | 4/2002 |
| WO | WO 03/087526 | A1 | | 10/2003 |
| WO | WO 2007/00576 | A1 | | 1/2007 |

* cited by examiner

B-B (1 : 8)

C-C (1 : 8)

A-A (1 : 8)

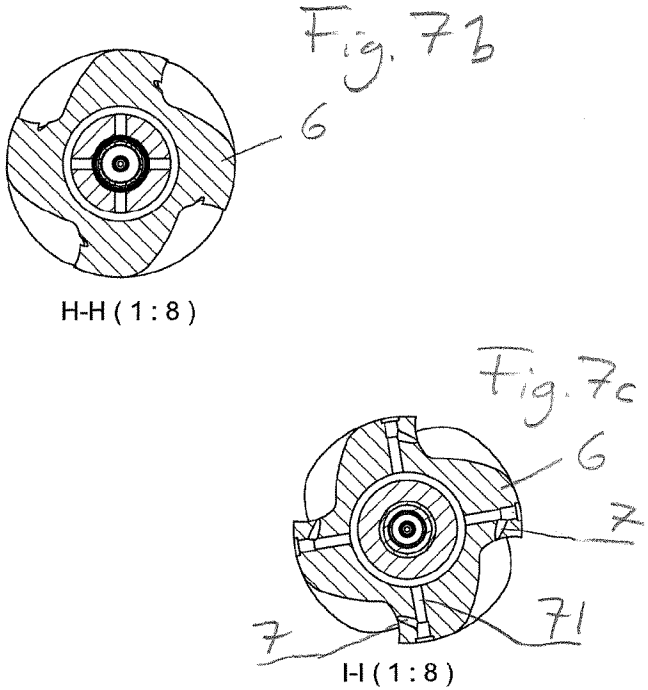
Fig. 7b
6
H-H (1:8)
Fig. 7c
6
7
71
7
I-I (1:8)
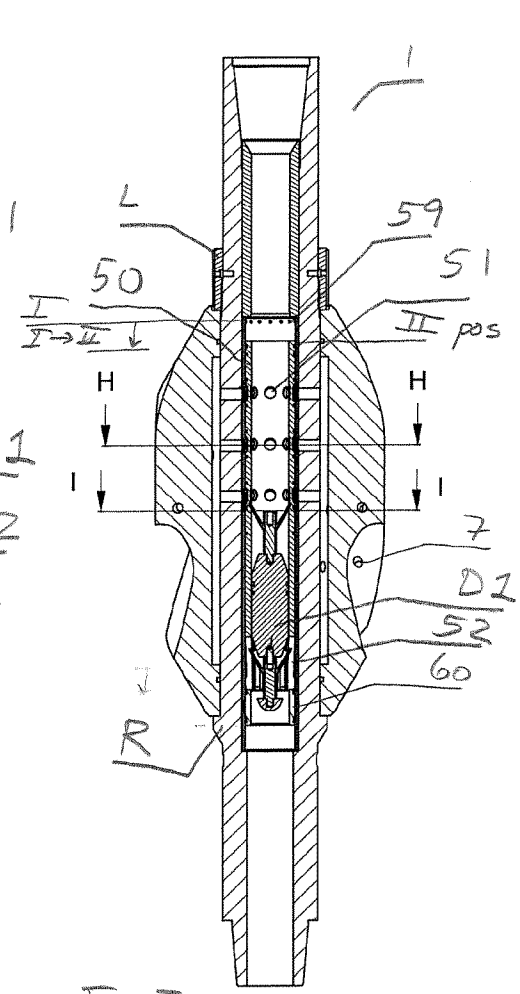
1
59
51
II pos
H
I
7
D1
52
60
L
50
I
I→II
R
G-G (1:8)
Fig. 7a
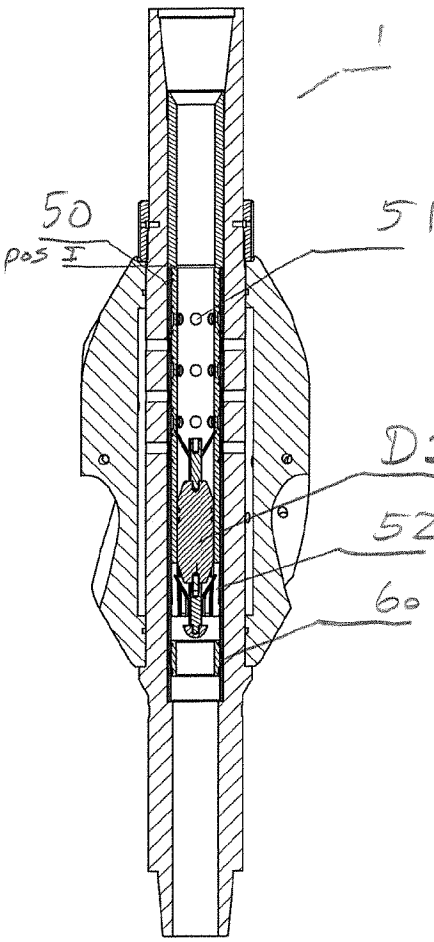
1
51
D1
52
60
50
pos I
F-F (1:8)
Fig. 6

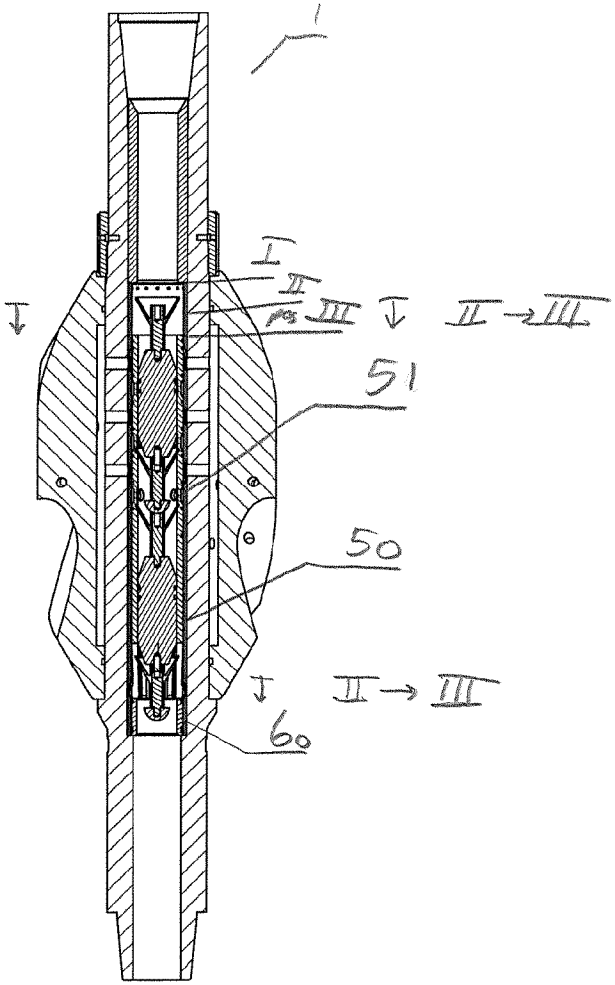
Fig. 9 K-K (1:8)
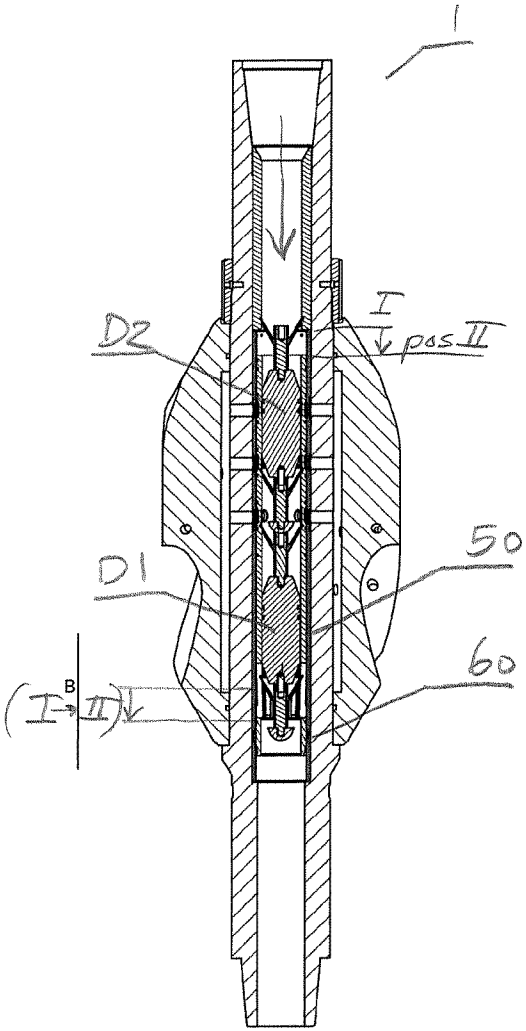
Fig. 8 J-J (1:8)

Figure 10C:
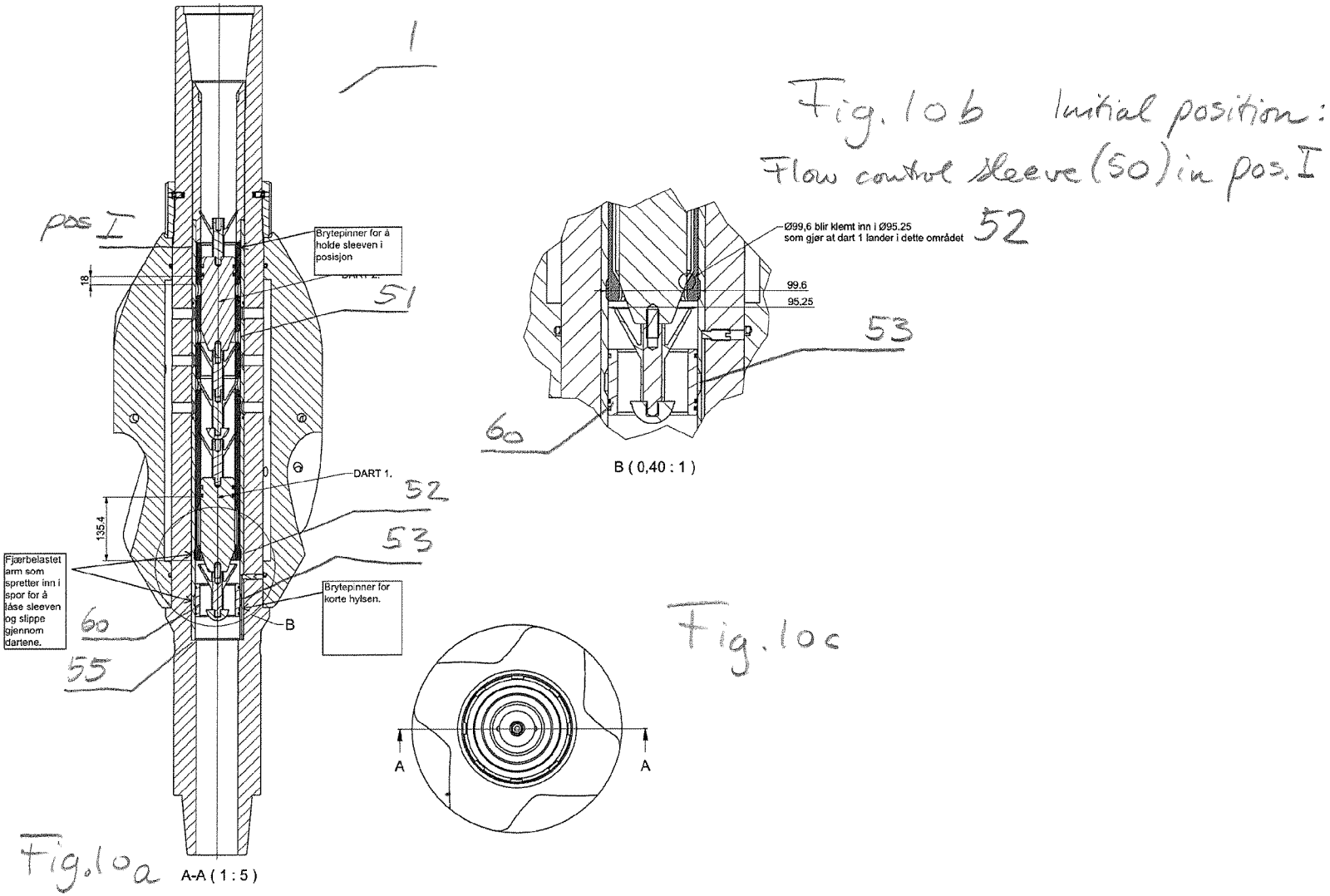

Fig. 10b Initial position:
Flow control sleeve (50) in pos. I
52
53
Ø99,6 blir klemt inn i Ø95,25
som gjør at dart 1 lander i dette området
99,6
95,25
B (0,40 : 1)
60

A
A
1
Brytepinner for å holde sleeven i posisjon
51
DART 1.
52
53
Brytepinner for korte hylsen.
B
pos I
18
135,4
60
55
Fjærbelastet arm som spretter inn i spor for å låse sleeven og slippe gjennom dartene.
Fig. 10a A-A (1 : 5)

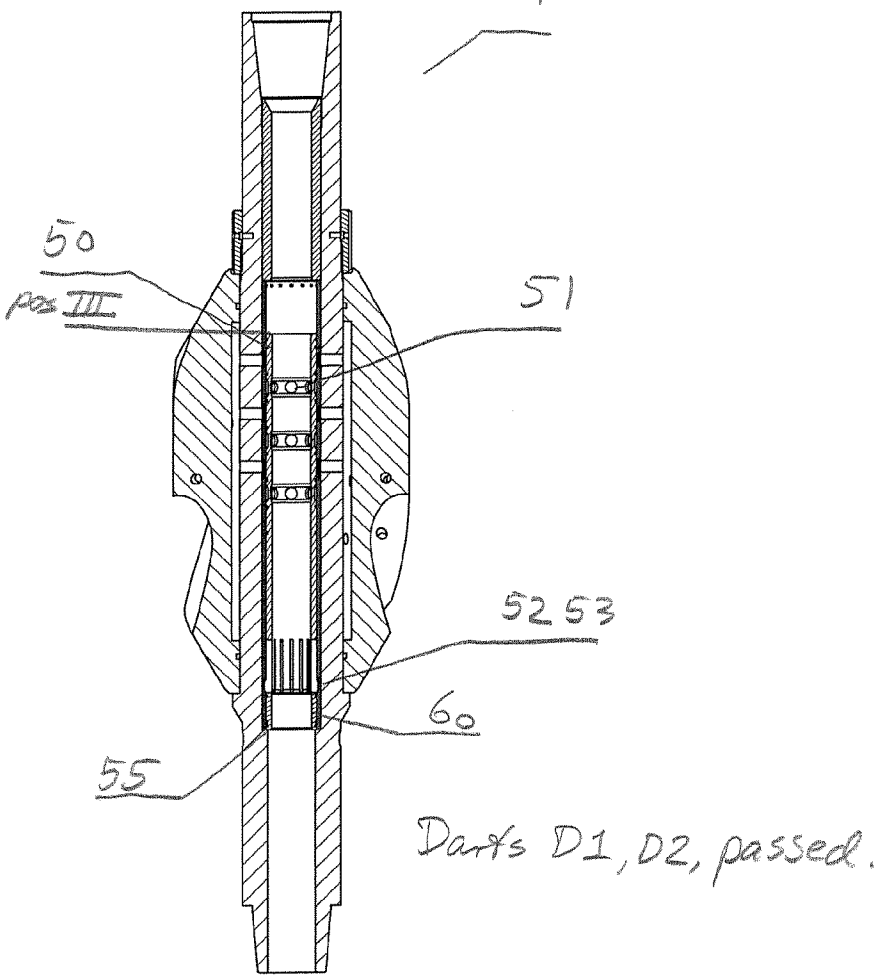
Fig. 11 L-L (1:8)

BLOWOUT PREVENTER CLEANING TOOL

The present invention is in the field of BOP's and Marine Riser Cleaning used in most on/offshore oil and gas wells. More particularly, the invention relates to a tool and a method for removal of accumulated magnetic objects and debris in a BOP and Marine Riser generated by wellbore operations. The tool according to the invention is normally run on a drill string and/or in combination with a wellbore cleanup operation.

BACKGROUND

During well operations debris is generated by tasks preformed. The debris can cause BOPs to malfunction, incurring underground blow-outs, rig fires, flow at surface and pressure kicks during drilling or workover operations. Even small objects can severely jeopardize well control, with potentially hazardous consequences to people, the environment and well components.

It is vital to the operations that debris is removed before, in or during operations to prevent potentially hazardous consequences to people, the environment and well components.

BACKGROUND ART

International patent application WO03087526A1 "Stabiliser, jetting and circulation tool", describes a downhole tool for use in a well bore, the tool comprising: a tubular body having an axial throughbore and adapted for connection within a work string; a sleeve mounted around the body, the sleeve including one or more stabiliser blades, said stabiliser blades including one more jetting ports to direct fluid from the axial throughbore onto a surface of the well bore; and one or more actuating means to selectively direct the fluid through the jetting ports and thereby circulate the fluid.

European patent application EP0654581A2 "Sub-surface release plug apparatus" describes "a sub-surface release plug apparatus, which comprises an upper plug (160) releasably attachable to a drill string (14) positionable in a well casing (116), said plug comprising a body (152) made of a non-metallic material having a compressive strength of at least 35,000 psi (241 MPa); a lower plug (232) releasably connected to said upper plug (160) and comprising a body (234) made of said non-metallic material; a collet (126) interconnecting said upper plug (160) with said drill string (14); a releasing sleeve (136) slidably disposed with respect to said collet (126) and adapted for holding said collet (126) in engagement with said drill string (14) when in a first position and adapted for releasing said collet (126) when in a second position; and a releasing plug (264, 464) adapted for engaging said releasing sleeve (136) and moving said releasing sleeve from said first position to said second position in response to a differential pressure across said releasing plug".

In the above mentioned EP application drilling out of the two plugs is described in p. 11: "After testing, the releasing dart or plug, the upper plug means, and the lower plug means are no longer needed. At this point, these components may be drilled out of casing 16 so that the well can be operated in production. The non-metallic components described herein facilitate this drilling operation and allow the use of different drill bits, rather than the conventional tri-cone drill bit. Referring now to FIG. 13, sub-surface release plug assembly 10, 10' or 10" is shown immediately above float chute 26. Releasing plug 264 or releasing dart 464 is engaged with the top of the plug assembly. For drilling, a tubing or drill string 478 is lowered into casing 16 with a drill bit 480 at the lower end. Standard tri-cone drill bits may be used, and variations in rotary speed and bit weight are not particularly critical because of the non-metallic components of sub-surface release plug assembly 10. This greatly simplifies the drilling operation and reduces the cost and time thereof."

International patent application WO99/14461, "A plug for use in wellbore operations, an apparatus for receiving said plug, a plug landing system and a method for cementing tubulars in a wellbore" describes a plug for use in wellbore operations, which plug is deformable such that, in use, upon fluid pressure reaching a predetermined level, said plug deforms allowing fluid to pass between said plug and a tubular in which said plug is located.

BRIEF SUMMARY OF THE INVENTION

The present invention is a pipe-born BOP cleaning tool comprising a first pipe section (1) with upper and lower threaded box (2) and pin (3) thread connections to pipe sections above and below, said pipe section (1) provided with a through central channel (5) and inner radial channels (70) in distinct levels to a distribution annulus (40) within an external tubular member (4) with external fins (6), said tubular member (4) having and outer radial channels (71) from said distribution annulus (40) to nozzles (7) between said fins (6) for flushing fluid from said central channel (5) out into a BOP bore for washing cavities in said said BOP bore, said central channel (5) provided with a flow control sleeve (50) provided with holes (51), said flow control sleeve (50) displaceable from a radially closed initial first closed position (I) to a second position (II) with said holes (51) aligned with said inner radial channels (70) for starting flushing through said nozzles (7), and further displaceable to a radially closed third position (III) with said holes (51) out of alignment with said inner radial channels (70) for halting said flushing through said nozzles (7), said flow control sleeve (50) displaceable from said first, initial position by a first dart (D1) dropped into said first pipe section (1) and stopping in a first seat (52) in said flow control sleeve (50) below said holes (51), thereby closing said central channel (5), building pressure in said central channel, displacing said flow control sleeve (50) to said second position (II) and redirecting pipe flow to said nozzles (7), said flow control sleeve (50) displaceable from said second position (II) to said third, closed position (III) by a second dart (D2) dropped into said first pipe section (1) and stopping at said first dart (D1), said second dart (D2) blocking said holes (51) thereby building pressure in said first pipe section, further displacing said flow control sleeve (50) to said third position (III) triggering a release mechanism (53) for said first seat (52) to release said first dart (D1) and said second dart (D2).

More generally expressed, the present invention is a BOP cleaning tool comprising a first pipe section (1) with with a through central channel (5) and radial channels to external fins (6), with nozzles (7) for flushing fluid from said central channel (5) out into a BOP bore for washing cavities in said said BOP bore, said central channel (5) provided with a flow control sleeve (50) provided with holes (51), said flow control sleeve (50) displaceable from a radially closed initial first closed position (I) to a second position (II) with said holes (51) aligned with said inner radial channels (70) for starting flushing through said nozzles (7), and further displaceable to a radially closed third position (III) with said holes (51) out of alignment with said inner radial channels (70) for halting said flushing through said nozzles (7).

The flow control sleeve (50) is displaceable from said first, initial position by a first dart (D1) dropped into said first pipe section (1) and stopping in a first seat (52) in said flow control sleeve (50) below said holes (51), thereby closing said central channel (5), building pressure in said central channel, displacing said flow control sleeve (50) to said second position (II) and redirecting pipe flow to said nozzles (7), said flow control sleeve (50) displaceable from said second position (II) to said third, closed position (III) by a second dart (D2) dropped into said first pipe section (1) and stopping at said first dart (D1), said second dart (D2) blocking said holes (51) thereby building pressure in said first pipe section, further displacing said flow control sleeve (50) to said third position (III) triggering a release mechanism (53) for said first seat (52) to release said first dart (D1) and said second dart (D2).

The present invention is a device for being used after any drilling operation to clean the riser and the BOP.

The invention is also a method for BOP cleaning comprising lowering a first pipe section (1) on a fluid-carrying string into a BOP, said pipe section (1) carrying fluid through central channel (5), said pipe section provided with and inner radial channels (70) in distinct levels to a distribution annulus (40) within an external tubular member (4) with external fins (6), said tubular member (4) having and outer radial channels (71) from said distribution annulus (40) to nozzles (7) between said fins (6) for flushing fluid from said central channel (5) out into a BOP bore for washing cavities in said said BOP bore, said central channel (5) provided with a flow control sleeve (50) provided with holes (51), displacing said flow control sleeve (50) from a radially closed initial first closed position (I) to a second position (II) for aligning said holes (51) with said inner radial channels (70) and starting flushing through said nozzles (7), and further displacing the flow control sleeve (50) to a radially closed third position (III) with said holes (51) out of alignment with said inner radial channels (70) for halting said flushing through said nozzles (7), displacing said flow control sleeve (50) from said first, initial position by dropping a first dart (D1) into said first pipe section (1), stopping in a first seat (52) in said flow control sleeve (50) below said holes (51), thereby closing said central channel (5), building pressure in said central channel, displacing said flow control sleeve (50) to said second position (II) and redirecting pipe flow to said nozzles (7), displacing said flow control sleeve (50) from said second position (II) to said third, closed position (III) by dropping a second dart (D2) into said first pipe section (1) and stopping at said first dart (D1), said second dart (D2) blocking said holes (51) thereby building pressure in said first pipe section, further displacing said flow control sleeve (50) to said third position (III) triggering a release mechanism (53) for said first seat (52) to release said first dart (D1) and said second dart (D2).

The Tornar BOP cleaning device of the present invention is specially designed to clean BOP areas such as Ram and Annular cavities. It's advantageous to combine cleaning of the BOP and the marine riser in the same run for an efficient solution. This saves rig time and minimizes equipment handling. In an embodiment the Tornar BOP cleaning device of the present invention is combined with a magnet device and brushes, thus turned into a single-trip system, which can be integrated with other wellbore cleaning tools during the displacement process.

By using the BOP cleaning device of the invention such situations can be avoided and operations can continue as planned in a safe and hazardous free manner.

FIGURE CAPTIONS

Figure 1:
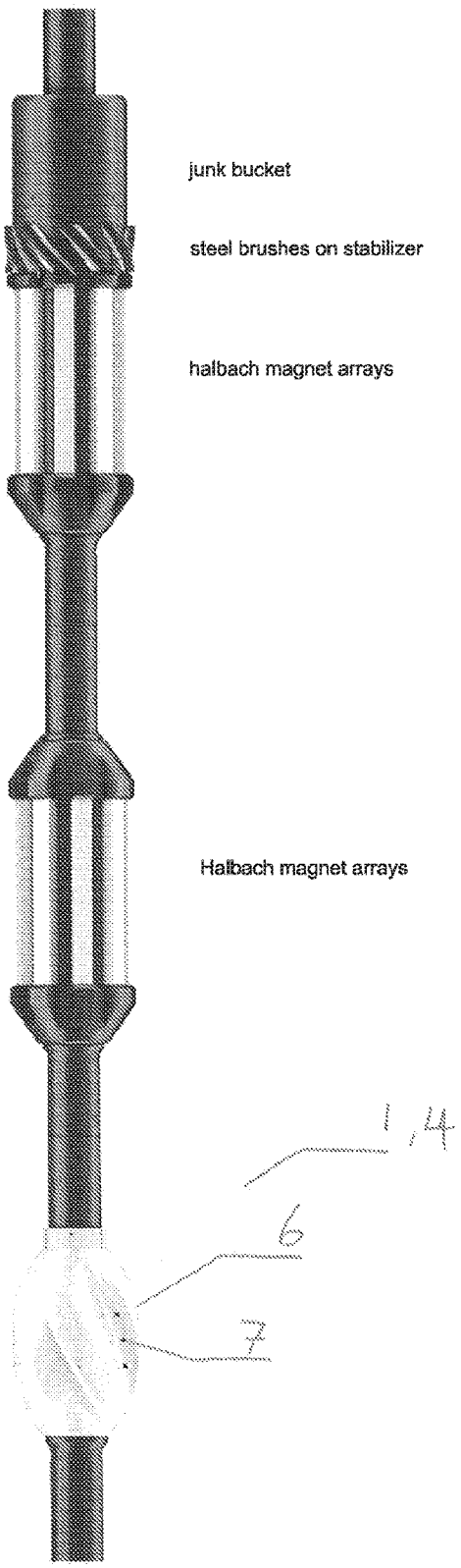

The invention is illustrated in the attached drawing Figures, wherein,

FIG. 1 is an elevation view of the pipe-born BOP cleaning tool of the invention, here showing a pipe section (1) in the lower part of the drawing provided with an external tubular member (4) with external fins (6) with flushing nozzles (7) in helicoidal trenches between part helix-shaped fins. The tubular member (4) with helix-shaped fins and flushing nozzles may be called a "Tornar body". Above the lower pipe-section (1) is shown two pipe sections (100, 200) each provided with longitudinally extending radial ribs (110) each rib (110) comprising a set of Halbach magnets (120) for binding magnetic debris and particles. At the top of the upper set of Halbach magnets (120) is a ring of brushes, preferably helix-shaped rows of brushes, and above this is a so-called junk bucket for catching released debris in the annular flow, the junk bucket provided with drainage holes just above the brush ring. The entire tool is run through a riser and a BOP in order to flush, clean and catch debris, particularly for flushing and cleaning cavities in the bore of the BOP.

Figures 2, 3A, 3B, 3C:
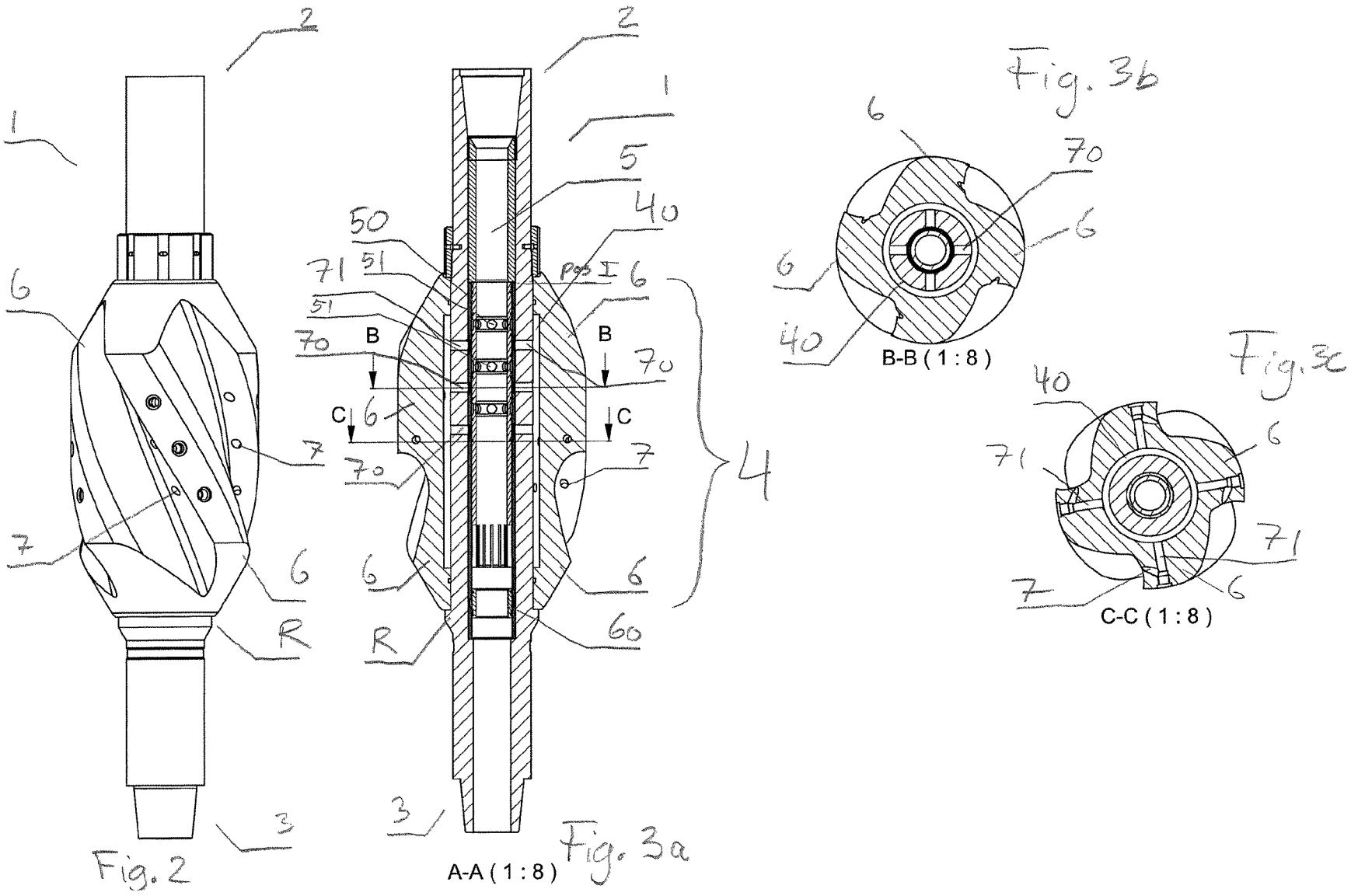

FIG. 2 is an elevation of the pipe section (1) with the tubular member (4) with the external fins (6) with flushing nozzles (7). The tubular member (4) rests on a ring shoulder below and is locked by an upper locking ring (L). The pipe section (1) and the tubular member (4) may in an alternative embodiment be formed in one material piece.

FIG. 3 is a vertical section through the pipe section (1) with the tubular member (4) with the fins (6), showing a central channel (5) and a flow control sleeve (50) for controlling radial flow to inner radial channels (70) leading indirectly via a distribution annulus (40) and outer radial channels (71) to nozzles (7) between said fins (6).

Figure 4:
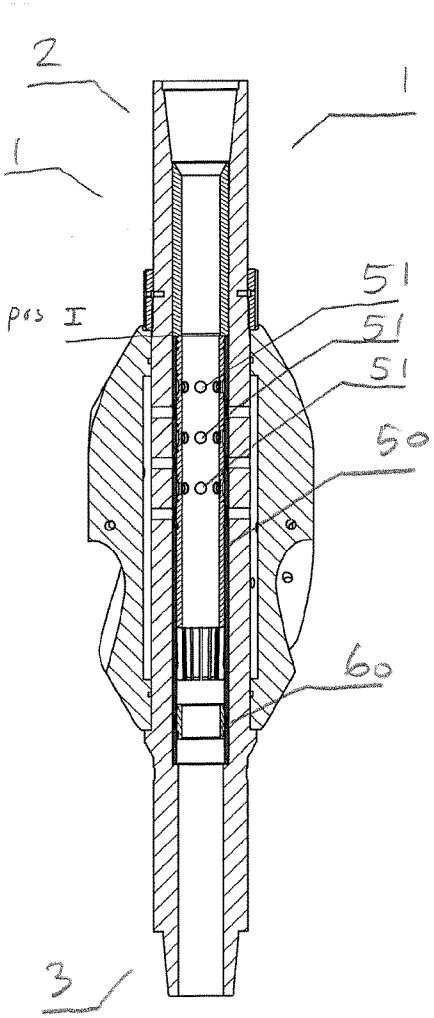

FIG. 4 shows the flow control sleeve (50) in a first, upper position (I). It may be temporarily fixed in this upper position (I) by shear pins (59), please see shear pins (59) broken and exposed in FIG. 7*a*. The pipe section (1) is here open for through flow to lower parts of the pipe string, such as providing drilling fluid to a working drill bit. The radial holes of the flow control sleeve are closed, the Tornar body is passively moving with the pipe string.

Figure 5:
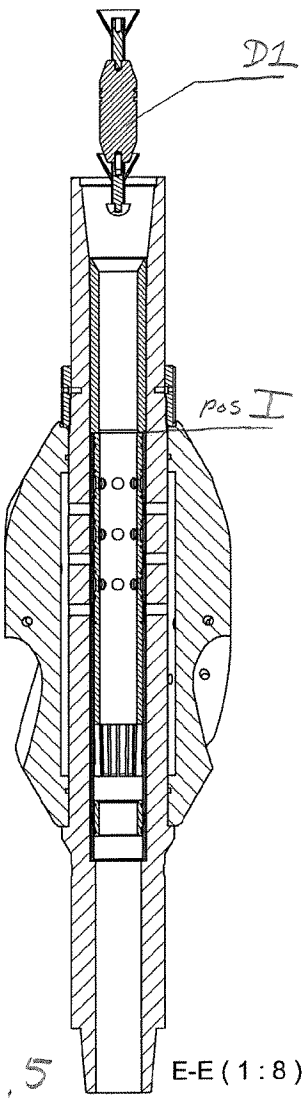

FIG. 5 shows a first dart (D1) dropped internally to the pipe section (1) with the pipe flow in order to activate the flow control sleeve (50).

FIG. 6 shows the first dart (D1) arrived at a first seat (52) in the flow control sleeve. The first dart (D1) closes the passage through the flow control sleeve (50) and thus blocks the pipe section (1). Fluid pressure may now be built up above the dart. The first seat comprises in the embodiment shown a ring of axially directed fingers with a common inwards-extending seat rim which catches the periphery of the dart.

FIG. 7*a* shows the result of the situation of pressure build-up in FIG. 6. The shear pins (59) or other temporary holding mechanism is released by the pressure and the flow control sleeve is moved with the first dart (D1) to a lower second position (II). Here the holes (51) become aligned with the inner radial channels (70), resulting in high pressure fluid being flushed out to and through nozzles (7) between the fins (6) in the so-called Tornar body. The Tornar body may be run within the casing and particularly in the BOP. The fluid flush from the nozzles (7) will high pressure flush cavities in the BOP main bore and remove debris. The debris will be transported upward from the BOP (or any location such as the casing in the wellbore) through the annulus with the fluid.

The problem is now how to get rid of the blocking first dart (D1) when the flushing operation is done, and continued vertical pipe flow is desired.

FIG. 8 shows the entry of a second dart (D2) which lands on the tail of the first dart (D1). It fills the diameter of the flow control sleeve (50), blocks the fluid flow to the holes (51) and stops the flushing of fluid through nozzles (7). Pressure may now be built up in the central channel (5) above the second dart (D2). An auxiliary sleeve (60) which until now held the lower end of the flow control sleeve (50) (the lower end of the locking fingers (58) of the flow control sleeve (50)) breaks loose due to the vertical force from the pressure, and lands at a third seat (55) below.

FIG. 9 shows the auxiliary sleeve (60) halted at the third seat (55) in the central channel (5). The Tornar flushing flow is now halted.

FIG. 10*a* is a slightly enlarged cross-section of the pipe section (1) with all the above-discussed components shown in cross-section, the flow control sleeve is in the initial position (I). FIG. 10A shows an enlarged portion of the nose of the first dart locked in the finger rim of the flow control sleeve (50), and the lower positioned (position (II)) auxiliary sleeve (60) which forms a shear-pin held seat for the flow control sleeve (50), and which covers a ring-shaped recess (53) which forms a seat for external finger rims on control sleeve (50) causing the fingers to widen up their grip for releasing the first dart (D1) (and the second dart (D2) too) when position (III) is reached.

FIG. 11 shows the resulting position (III) of flow control sleeve (50), with the darts released and passed further down. Flow may now resume. The darts may be retrieved in a so-called "dart catcher" further down in the pipe string.

Figure 12:
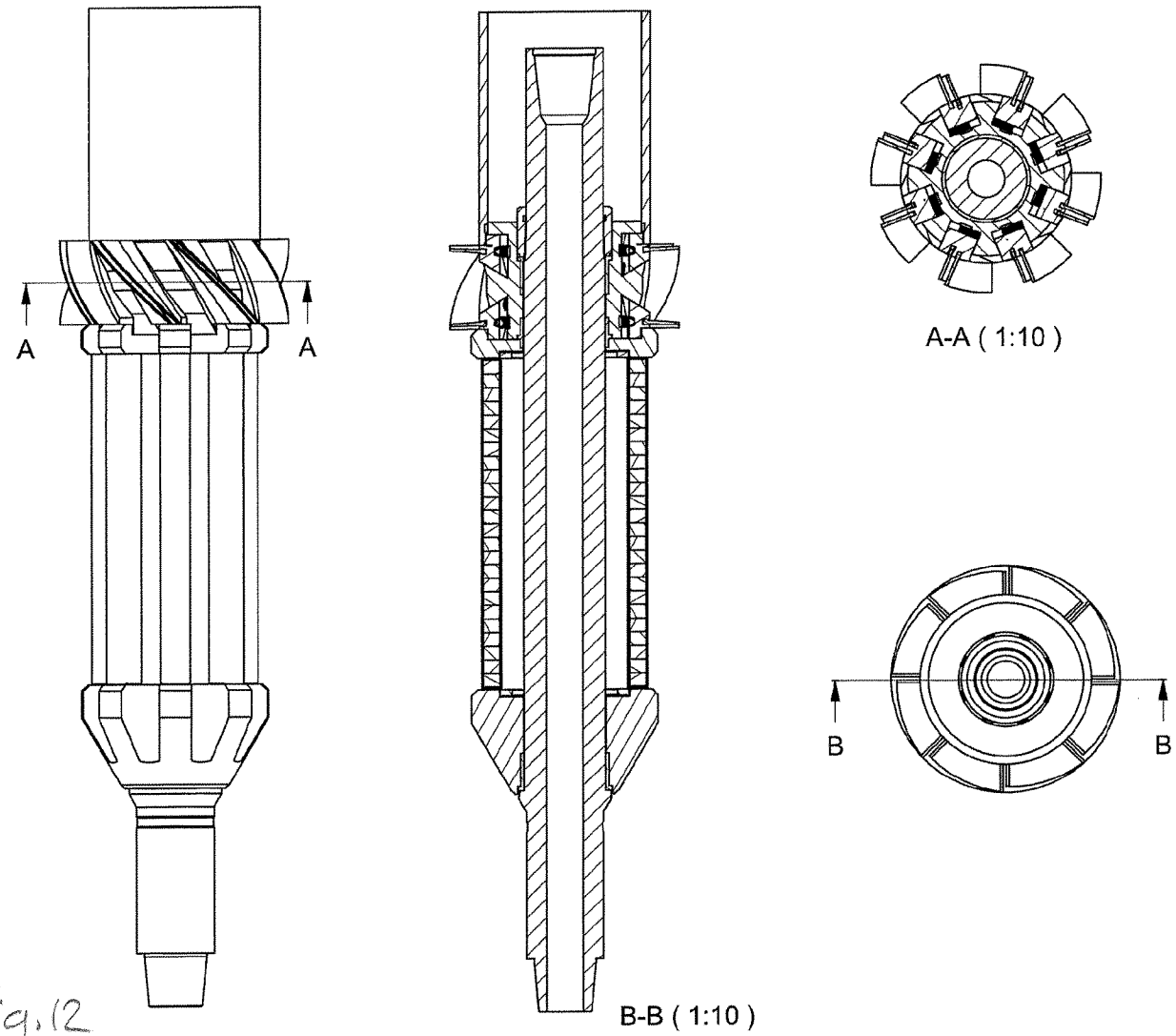

FIG. 12 shows details of the Halbach magnet array and the radial brushes and the junk bucket above.

EMBODIMENTS OF THE INVENTION

The present invention is a pipe-born BOP cleaning tool comprising a first pipe section (1) with upper and lower threaded box (2) and pin (3) thread connections to pipe sections above and below, wherein said pipe section (1) is provided with a through central channel (5) and inner radial channels (70) in distinct levels to a distribution annulus (40) within an external tubular member (4) with external fins (6). Said tubular member (4) has outer radial channels (71) from said distribution annulus (40) to nozzles (7) between said fins (6) for flushing fluid from said central channel (5) out into a BOP bore for washing cavities in said said BOP bore. The pipe section (1) and the tubular member (4) may be manufactured in one single piece, omitting the distribution annulus between the inner radial channels (70) and the outer radial channels (71) which may be combined into radial channels (70, 71) to the nozzles (7). The nozzles (7) are preferably inserted at an angle into the outer radial channel (71) in order to be directed with a significant tangential component in order to initiate a toroidal movement to the fluid flow in the same direction as the helicoidal twist of the space between the fins (6).

The central channel (5) is provided with a flow control sleeve (50) provided with radially directed holes (51) in several elevation levels of the flow control sleeve. The flow control sleeve (50) displaceable from an initial first position (I) to two lower positions (II) and (III) as described below. First, it is displaceable from a radially closed initial first closed position (I) where it may be held by shear pins or similar temporary holding mechanism, to a second position (II) with said holes (51) aligned with said inner radial channels (70) for starting flushing through said nozzles (7), and further displaceable to a radially closed third position (III) with said holes (51) out of alignment with said inner radial channels (70) for halting said flushing through said nozzles (7).

The flow control sleeve (50) is displaceable from said first, initial position by a first dart (D1) dropped into said first pipe section (1) and stopping in a first seat (52) in said flow control sleeve (50) below said holes (51), thereby closing said central channel (5), building pressure in said central channel, displacing said flow control sleeve (50) to said second position (II) and redirecting pipe flow to said nozzles (7).

The flow control (5) is displaceable from said second position (II) to said third, closed position (III) by a second dart (D2) dropped into said first pipe section (1) and stopping at said first dart (D1), said second dart (D2) blocking said holes (51) thereby building pressure in said first pipe section, further displacing said flow control sleeve (50) to said third position (III) triggering a release mechanism (53) for said first seat (52) to release said first dart (D1) and said second dart (D2).

In an embodiment of the invention the pipe-born BOP cleaning tool comprises an auxiliary sleeve (60) below said flow control sleeve (50) and in said central channel (5) for constituting a second seat (54) for said flow control sleeve (50) halting in said second position (II).

In an embodiment the pipe-born BOP cleaning tool of the invention, said central channel (5) comprises a third seat (55) for halting said auxiliary sleeve (60) with said flow control sleeve (50) in its third position (III).

The external fins (6) preferably have a partial helix-shape.

The pipe-born BOP cleaning tool may in an embodiment of the invention comprise one or more pipe sections (100) comprising externally directed Halbach magnets, arranged above the Tornar flushing unit.

The Tornar BOP cleaner device removes wellbore debris from blow-out preventer (BOP) rapidly and reliably. Its combination of Tornar angled flow ports, i.e. having nozzles (7) directed with a tangential component, preferably with a large outside diameter (OD), creates a powerful cyclone effect that clears potentially hazardous debris from ram and annular cavities—without damaging the BOP.

The Tornar BOP Cleaner string combines Tornar flow ports with a large OD to create a powerful cyclone of drilling fluid. When the cyclone passes any BOP cavity, the differential pressure engulfs any accumulated debris and retains it in the drilling fluid. To increase the efficiency of the cyclone and ensure the effective retrieval of magnetic debris, a magnet is arranged above fitted to the Tornar BOP Cleaner string. Preferably the magnets are arranged in a Halbach array so as for increasing the magnetic field strength externally, and decreasing the magnetic field strength internally in the direction of the central channel through the string.

The tool according to the invention provides a high fluid pressure for cleaning within the BOP and its inward-facing cavities for effective cleaning and reduces BOP and marine riser maintenance cost.

The Large OD BOP Magnets are used to remove metal and carry out metal objects from the wellbore. Several long Halbach magnet rods are placed in a non-magnetic housing with a circular pattern, such as illustrated in FIG. 1, and shown in FIG. 12. This gives sufficient magnet projection and influence on magnetic debris to remove it and carries it out of the BOP and marine riser. The Halbach magnet rod ensures that magnetic debris is carried out on the large surface and leaves flow passages unrestricted.

The tool of the invention with its laterally, preferably tangentially directed nozzles (7), the so-called Tornar angled flow ports, creates a powerful flushing flow, preferably a cyclone flow, of drilling fluid for effective debris removal and lift. When the cyclone flow passes any BOP cavity, the differential pressure engulfs any accumulated debris and retains it in the drilling fluid.

In a BOP cleaning operation an unrestricted ID is important to maintain well integrity for pumping access or wireline operations.

In operation, in upper position the flow control sleeve closes the Tornar flow ports and has an open through bore ID for pumping access and/or wireline operation. The Flow control sleeve is held in upper position by shear pins/bolts. This ensures wellbore integrity and access to pumping or other operations in case of an uncontrolled blow out.

By introducing a steel ball, dart or differential pressure the flow control sleeve is shifted from initial position (I) to center position (II) by applying pump pressure. The flow control sleeve is locked in center position (II) by a collet. This opens the Tornar flow ports and closes of fluid communication below the flow sleeve, all pumped fluid is now directed out the Tornar flow ports for the most effective cleaning of BOP and Marine Riser.

By introducing the second dart, differential pressure fluid communication with the Tornar flow ports are closed. By applying pump pressure the auxiliary collet is sheared and the flow control sleeve moves in to lower position (III). This permanently closes the Tornar flow ports and releases all steel balls or darts. These land in a separate catcher attached to the Tornar Tool. Wellbore integrity is now established and access to pumping or other operations in case of an uncontrolled blow out is possible.

The Tornar sleeve can have an adjustable OD to suite different size BOP, Riser and/or running in to any size wellbore below BOP or Riser. Thus the arrangement with a replaceable external tubular member (4) with external fins (6), whereof one may pick the desired diameter between a range of available diameters.

The Large OD BOP Magnets are used to remove metal and carry out metal objects from the wellbore. Several long Halbach magnet rods are placed in a non-magnetic housing with a circular pattern such as illustrated in FIG. 12. This gives sufficient magnet projection and influence on magnetic debris to remove it and carry it out of the BOP and marine riser. The Halbach magnet rod ensures that magnetic debris is carried out on the large surface and leaves flow passages unrestricted.

Halbach Magnet Rod and Housing

The Halbach Magnet Rod is a magnetized rod composed of ferromagnetic blocks. A Halbach array is a special arrangement of permanent magnets that augments the magnetic field on one side of the array while almost cancelling the field to near zero on the opposite sides. The Halbach Array rod is contained by epoxy inside a nonmagnetic housing. The housings are evenly distributed around a non-magnetic cylinder. This combination of Halbach Array and nonmagnetic housing creates a more powerful surface magnetic field at the face towards the fluids. This intense magnetic field is utilized to attract magnetic fragments, steel debris and missing parts that are not desired in a wellbore. The strong external field and the low inward field towards the central passage (5) prevent magnetism from magnet to be unnecessary strong within the internal flow passage and body that could result in magnetic debris buildup inside the tool. Plugging up the hole tool may cause circulation problems. The flow passages are made to transport fluid past the magnet rods and outside the magnet field to prevent swab and surge.

Improper Marine Riser cleaning can cause debris to fall into the wellbore, possibly damaging or plugging the productive zone, and impeding the running of the completion assembly. Proper cleaning contributes to a successful completion and reduces the potential for wellbore contamination. In an embodiment of the invention the tool may be provided with brushes as a top box stabilizer on a BOP magnet. This new stabilizer will have brush segments that cover 360° and a junk bucket on top to collect debris.

The brush segments will polish and remove mud film and other restrictive material from the ID of the Marine Riser As the large OD stabilizers are RIH the restricted flow passaged outside the stabilizer will increase fluid velocity and lift debris past the stabilizer, and prevent the debris to fall in to the wellbore. When the debris passes the junk bucket fluid velocity will decrease and heavy debris will fall in to the junk bucket. The Riser Brush stabilizer will have several functions: Act as a support to keep the tool centered in Riser. The stabilizer blades will have circular pattern for flow passage and 360° support. Hold the spring loaded brush carriers in place and act as support for these. Hold the junk bucket in place. It will be hold in place by a machined profile in stabilizer and bucket for support. Rotate freely on the mandrel as designed on standard stabilizers.

The brush segments are placed in a circular pattern to create or maintain a Tornar effect and help carrying debris past the brushes. Each Brush segment is placed in a brush carrier with machined slotted grooves. Each brush carrier will be evenly spring-loaded with multiple springs to maintain a permanent pressure to the brush segments. There are 2 ea brush segment in each brush carrier so sufficient flow passage are maintained. Brush carriers are locked in place by stabilizer and Junk Bucket. The Junk bucket on top is used to collect debris cleaned for the Riser ID walls and circulated debris from the Tornar Tool. The junk bucket is attached to top stabilizer. Drain ports are machined to drain well fluid from the junk bucket at surface. There are no external bolts or looking mechanisms. All bolts are internal to avoid parts falling in to the wellbore.

The invention claimed is:

1. A pipe-born BOP cleaning tool comprising:

a first pipe section with upper and lower threaded box and pin thread connections to pipe sections above and below;

said first pipe section provided with a through central channel and inner radial channels in distinct levels to a distribution annulus within an external tubular member with external, partial helix-shaped fins;

said tubular member having outer radial channels from said distribution annulus to nozzles between said fins, said nozzles having a tangential direction component, for flushing fluid from said central channel out into a BOP bore for washing cavities in said BOP bore;

said central channel provided with a flow control sleeve provided with holes;

said flow control sleeve displaceable from a radially closed initial first closed position to a second position with said holes aligned with said inner radial channels for starting flushing through said nozzles, and further displaceable to a radially closed third position with said holes out of alignment with said inner radial channels for halting said flushing through said nozzles; and said flow control sleeve displaceable from said first, initial position by a first dart dropped into said first pipe section and stopping in a first seat in said flow control sleeve below said holes, thereby closing said central channel, building pressure in said central channel, displacing said flow control sleeve to said second position and redirecting pipe flow to said nozzles, wherein said flow control sleeve is displaceable from said second position to said third, closed position by a second dart dropped into said first pipe section and stopping at said first dart, said second dart blocking said holes thereby building pressure in said first pipe section, further displacing said flow control sleeve to said third position triggering a release mechanism for said first seat to release said first dart and said second dart.

2. The pipe-born BOP cleaning tool of claim 1, further comprising an auxiliary sleeve below said flow control sleeve and in said central channel for constituting a second seat for said flow control sleeve halting in said second position.

3. The pipe-born BOP cleaning tool of claim 1, said central channel comprising a third seat for halting said auxiliary sleeve with said flow control sleeve in its third position.

4. The pipe-born BOP cleaning tool of claim 1, comprising one or more pipe sections comprising Halbach magnets.

5. A method for BOP cleaning comprising the steps of:

lowering a first pipe section on a fluid-carrying string into a BOP;

said pipe section carrying fluid through central channel, said pipe section provided with and inner radial channels in distinct levels to a distribution annulus within an external tubular member with external partial helix-shaped fins, said tubular member having and outer radial channels from said distribution annulus to nozzles, said nozzles having a tangential direction component between said fins for flushing fluid from said central channel out into a BOP bore for washing cavities in said BOP bore;

said central channel provided with a flow control sleeve provided with holes;

displacing said flow control sleeve from a radially closed initial first closed position to a second position for aligning said holes with said inner radial channels and starting flushing through said nozzles;

further displacing the flow control sleeve to a radially closed third position with said holes out of alignment with said inner radial channels for halting said flushing through said nozzles;

displacing said flow control sleeve from said first, initial position by dropping a first dart into said first pipe section, stopping in a first seat in said flow control sleeve below said holes, thereby closing said central channel, building pressure in said central channel, displacing said flow control sleeve to said second position and redirecting pipe flow to said nozzles; and displacing said flow control sleeve from said second position to said third, closed position by dropping a second dart into said first pipe section and stopping at said first dart, said second dart blocking said holes thereby building pressure in said first pipe section, further displacing said flow control sleeve to said third position triggering a release mechanism for said first seat to release said first dart and said second dart.

* * * * *